United States Patent [19]

D'Amico

[11] 4,199,071

[45] Apr. 22, 1980

[54] CLOSURE WITH IMPROVED PULL TAB

[75] Inventor: Richard L. D'Amico, Mundelein, Ill.

[73] Assignee: Baxter Travenol Laboratories, Inc., Deerfield, Ill.

[21] Appl. No.: 904,422

[22] Filed: May 10, 1978

[51] Int. Cl.[2] ..... B65D 41/32

[52] U.S. Cl. ..... 215/256

[58] Field of Search ..... 215/254, 253, 256; 220/270

[56] References Cited

U.S. PATENT DOCUMENTS

| | | | |
|---|---|---|---|
| 3,073,472 | 1/1963 | Williams | 215/256 |
| 3,338,446 | 8/1967 | Faulstich | 215/256 |
| 3,371,814 | 3/1968 | Ruprecht | 215/254 |
| 3,407,957 | 10/1968 | Robinson | 215/256 |
| 3,913,771 | 10/1975 | Acton | 215/256 |

FOREIGN PATENT DOCUMENTS

| | | | |
|---|---|---|---|
| 1521919 | 4/1968 | France | 215/256 |
| 102825 | 12/1959 | Norway | 215/256 |
| 1205541 | 9/1970 | United Kingdom | 215/254 |
| 1509548 | 5/1978 | United Kingdom | 215/256 |

OTHER PUBLICATIONS

Prior art cited by applicant in paper filed May 10, 1978, noted as Re. D'Amico case 11100.

*Primary Examiner*—George T. Hall

*Attorney, Agent, or Firm*—Paul C. Flattery; John P. Kirby, Jr.; George H. Gerstman

[57] ABSTRACT

A closure cap with the lower portion thereof being sealed to the container and an upper portion being separated from the lower portion by a tear strip. A handle extends outwardly from the tear strip and is formed integrally with the tear strip. An angled gusset bridges the handle and the tear strip to extend the fulcrum point of the handle into the tear strip tear direction thereby providing relatively greater leverage.

12 Claims, 5 Drawing Figures

FIG. 3
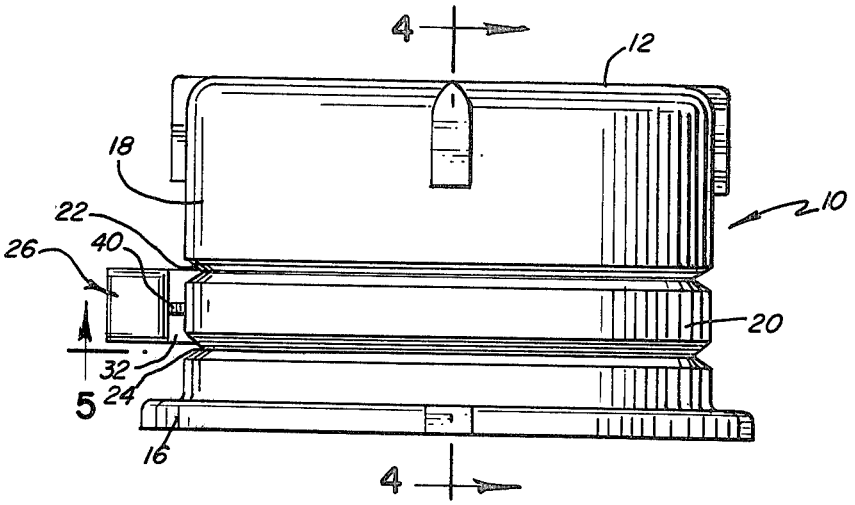
FIG. 4
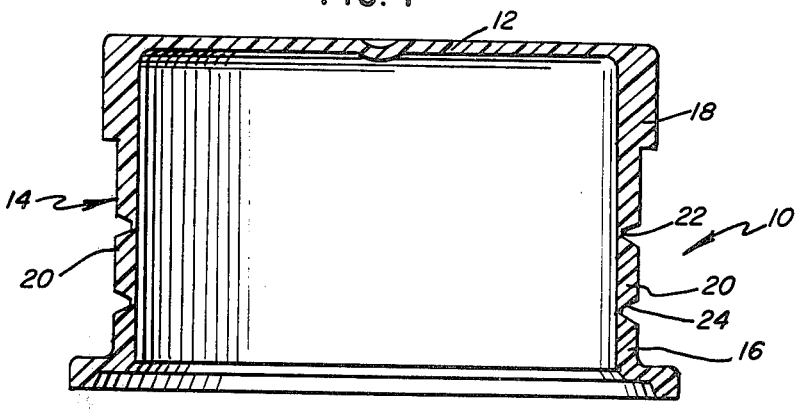
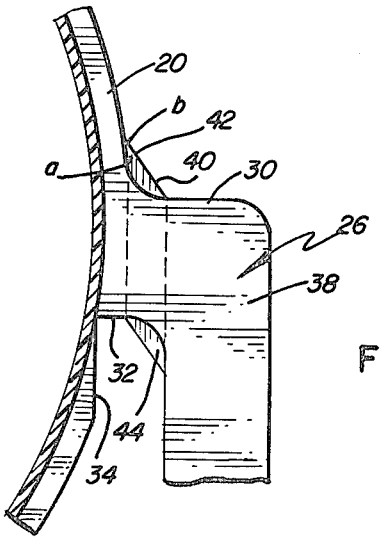
FIG. 5

CLOSURE WITH IMPROVED PULL TAB

BACKGROUND OF THE INVENTION

This invention relates to an improved closure cap of the type in which a tear strip separates the upper portion of the closure cap from a lower portion that is connected to a container.

While closure caps of the type described herein are particularly useful in the medical field on plastic bottles containing parenteral liquids, it is to be understood that the closure cap of the present invention is adaptable for use with many different types of containers in which access to the container is prevented until a tear strip is removed.

Prior art closures in which a lower portion of the closure is sealed to the container and an upper portion of the closure is separated from the lower portion by a tear strip are widely used in the medical field. Many of these prior art closures are formed of plastic and comprise a pair of parallel peripheral grooves which define a tear strip separating the upper portion from the lower portion, and a handle extends outwardly from the tear strip and is operable when pulled to remove the tear strip. Examples of such closure caps are described in Bathish, et al. U.S. Pat. No. 3,394,831 and Robinson U.S. Pat. No. 3,407,957.

I have discovered that by using certain prior art tear strip type closure caps, it is occasionally difficult to tear off the strip and, on occasion, the handle will flex and break prior to removal of the tear strip. One of the possible reasons for such difficulty is the plastic mold parting line which typically extends vertically along one side of the cap at the line where the handle is connected (or formed integrally with) the tear strip.

It is, therefore, an object of the present invention to alleviate the difficulty experienced in removing the tear strip on occasion.

Another object of the present invention is to alleviate the problem of handle breakage during removal of the tear strip.

Other objects and advantages of the present invention will become apparent as the description proceeds.

BRIEF DESCRIPTION OF THE INVENTION

In accordance with the present invention, a closure cap is provided for a container in which the closure cap has a lower portion sealed to the container and an upper portion adapted for removal to enable access to the material within the container. The closure cap has a pair of peripheral grooves which define a tear strip separating the upper portion from the lower portion, and a handle extends outwardly from the tear strip and is operable when pulled to remove the tear strip.

The improvement comprises the handle having a portion contiguous with the tear strip and extending radially outwardly from the cap with one side of the handle portion facing the tear direction and being rigidly connected to the tear strip and the other side of the handle portion facing the opposite direction. One end of the tear strip terminates adjacent the other handle side to provide a frangible start location. A gusset is provided to bridge the handle portion and tear strip on the one handle side to extend the fulcrum point of the handle into the tear strip tear direction thereby providing relatively greater leverage.

In the illustrative embodiment, the handle has a graspable outer portion extending substantially normal to the radially outwardly extending portion. A second gusset is provided to bridge the radially outwardly extending portion and the outer handle portion to rigidify the handle.

In the illustrative embodiment, the radially outwardly extending portion has substantially the same height as the tear strip and is formed integrally with the tear strip. The gusset has a significantly smaller height dimension than the height of the radially outwardly extending portion, and has an outer edge that defines an angle of between 20° and 50° between the tear strip and the outer edge.

A more detailed explanation of the invention is provided in the following description and claims, and is illustrated in the accompanying drawings.

BRIEF DESCRIPTION OF THE DRAWINGS

FIG. 3 is a side elevational view of the closure cap of FIG. 1;

FIG. 4 is a cross-sectional view thereof, taken along the plane of the line 4—4 of FIG. 3; and FIG. 5 is a fragmentary bottom view, partially in cross-section, of the handle of the closure cap of FIG. 3.

DETAILED DESCRIPTION OF THE ILLUSTRATIVE EMBODIMENT

Figure 1:
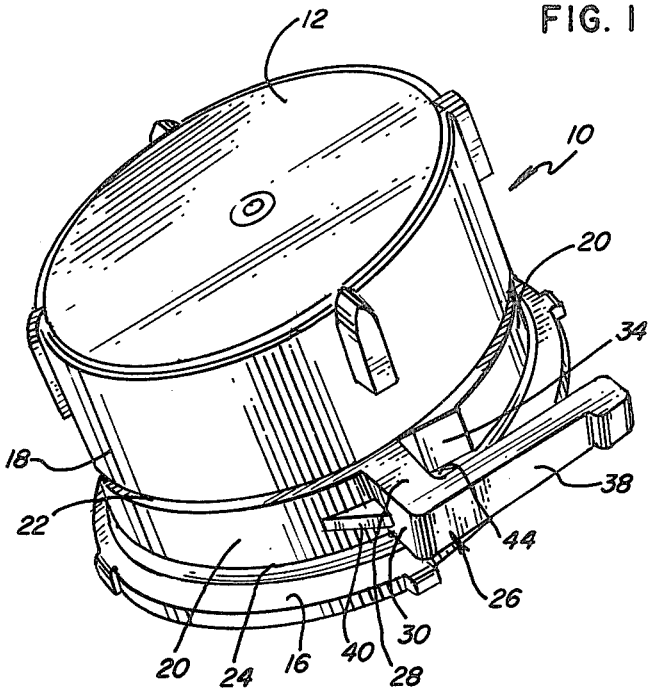
FIG. 1 is a perspective view of a closure cap constructed in accordance with the principles of the present invention.
Figure 2:
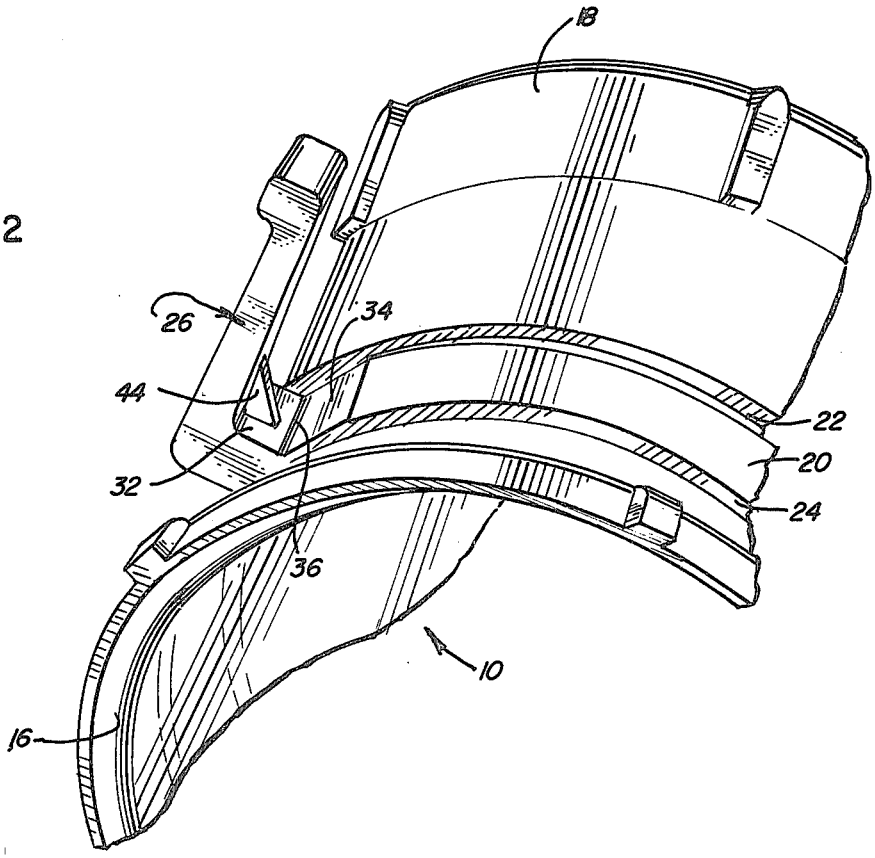
FIG. 2 is a fragmentary perspective view taken from below the closure cap of FIG. 1.

Referring to the drawings, a closure cap 10 is shown therein having a top wall 10 and a downwardly depending cylindrical side wall 14. A lower portion 16 of side wall 14 is adapted for connection to a container, by techniques well-known in the art, such as sonic welding, spin welding or heat welding. An upper portion 18, which includes top portion 12, is separated from lower portion 16 by means of a tear strip 20 which is defined by parallel peripheral grooves 22 and 24. A handle 26 is formed integrally with tear strip 20. Handle 26 has a portion 28 that is contiguous with tear strip 20 and extends radially outwardly from cap 10. One side 30 of handle 26 faces the tear direction and is rigidly connected to the tear strip 20 by being formed integrally therewith. The other side 32 of handle 26 faces the opposite direction to the tear direction.

One end 34 of tear strip 20 is tapered and terminates adjacent handle side 32, prior to engagement with handle side 32 thereby leaving a very small area 36 in which no tear strip is present. The termination of tear strip 20 prior to engagement with handle 26 and adjacent handle side 32 provides a frangible start location for the tearing operation.

While portion 28 of handle 26 extends radially outwardly from the cap, handle 26 has a manually-graspable outer portion 38 which extends normal to the radially outwardly extending portion 28.

In accordance with the present invention, the fulcrum position for opening the tear strip is effectively moved into the tear direction by the use of an angled gusset 40 which bridges handle 26 and tear strip 20, thereby providing relatively greater leverage. Angled gusset 40 operates to move the initial break into the tear portion of the tear strip 20, enabling the tear strip to be easier to remove.

It is preferred that gusset 40 have an outer edge 42 which defines an angle a of about 20° to 50°, preferably about 35°, between tear strip 20 and side 42. In order to add strength to the handle, a second gusset 44 is provided to bridge side 32 and outwardly extending portion 38. It is preferred that gussets 40 and 44 have outer edges which are parallel, as illustrated in FIG. 5.

In the illustrative embodiment, handle portion 28 has the same height as tear strip 20 while gussets 40 and 44 have a significantly smaller height dimension than the height of handle portion 28.

The illustrative embodiment is particularly useful with medical containers. In such embodiment, a closure cap formed of a polyolefin material is preferred.

In the operation of the closure cap, the cap is connected to a container in a conventional manner. Access to the material within the container is prevented until tear strip 20 is removed. To remove tear strip 20, handle 26 is grasped and the handle is pulled in the tear direction. Angled gusset 40 operates to move the fulcrum position to point b (see FIG. 5), thereby moving the initial break further into the tear strip yielding an easier tear, with the handle 26 being rigidified by gusset 44.

Although an illustrative embodiment of the invention has been shown and described, it is to be understood that various modifications and substitutions may be made by those skilled in the art without departing from the novel spirit and scope of the present invention.

What is claimed is:

1. A closure cap for a container in which the closure cap has a lower portion sealed to the container and an upper portion adapted for removal to enable access to the material within the container, a pair of peripheral grooves defining a tear strip which separates the upper portion from the lower portion, and a handle extending outwardly from the tear strip and operable when pulled to remove the tear strip, the improvement comprising, in combination:

said handle having a portion contiguous with said tear strip and extending radially outwardly from said cap with one side of said handle portion facing the tear direction and being rigidly connected to said tear strip and the other side of the handle portion facing the opposite direction;

one end of the tear strip terminating adjacent said other handle side to provide a frangible start location; and a gusset bridging said handle portion and tear strip on said one handle side to extend the fulcrum point of the handle into the tear strip tear direction thereby providing relatively greater leverage.

2. A closure cap as described in claim 1, said handle having a graspable outer portion extending substantially normal to said radially outwardly extending portion, and a second gusset bridging said radially outwardly extending portion and said outer normally extended handle portion to rigidify said handle.

3. A closure cap as described in claim 1, said radially outwardly extending portion having substantially the same height as the tear strip and being formed integrally with the tear strip.

4. A closure cap as described in claim 3, said angled gusset having a significantly smaller height dimension than the height of said radially outwardly extending portion.

5. A closure cap as described in claim 4, said gusset having an outer edge that defines an angle of about 20° to 50° between the tear strip and said outer edge.

6. A closure cap as described in claim 2, said first and second gussets having outer edges that are substantially parallel to each other.

7. A closure cap as described in claim 1, wherein said one end of the tear strip is tapered inwardly and terminates prior to engagement with said handle.

8. A closure cap for a container in which the closure cap has a lower portion sealed to the container and an upper portion adapted for removal to enable access to the material within the container, a pair of peripheral grooves defining a tear strip which separates the upper portion from the lower portion, and a handle extending outwardly from the tear strip and operable when pulled to remove the tear strip, the improvement comprising, in combination: said handle having a portion contiguous with said tear strip and extending radially outwardly from said cap with one side of said handle portion facing the tear direction and being rigidly connected to said tear strip and the other side of the handle portion facing the opposite direction;

one end of the tear strip terminating adjacent said other handle side to provide a frangible start location; and a first gusset bridging said handle and tear strip on said one handle side to extend the fulcrum point of the handle into the tear strip tear direction thereby providing relatively greater leverage;

said handle having a graspable outer portion extending substantially normal to said radially outwardly extending portion, and a second gusset bridging said radially outwardly extending portion and said normally extending outer handle portion to rigidify said handle;

said radially outwardly extending portion having substantially the same height as the tear strip and being formed integrally with the tear strip;

said first gusset having a significantly smaller height dimension than the height of said radially outwardly extending portion.

9. A closure cap as described in claim 8, wherein said one end of the tear strip is tapered inwardly and terminates prior to engagement with said handle.

10. A closure cap for a container in which the closure cap has a lower portion sealed to the container and an upper portion adapted for removal to enable access to the material within the container, a pair of peripheral grooves defining a tear strip which separates the upper portion from the lower portion, and a handle extending outwardly from the tear strip and operable when pulled to remove the tear strip, the improvement comprising, in combination:

said handle having a portion contiguous with said tear strip and extending radially outwardly from said cap with one side of said handle portion facing the tear direction and being rigidly connected to said tear strip and the other side of the handle portion facing the opposite direction;

one end of the tear strip being tapered inwardly and terminating prior to engagement with said handle to provide a frangible start location;

a gusset bridging said handle and tear strip on said one handle side to extend the fulcrum point of the handle into the tear strip tear direction thereby providing relatively greater leverage; and said radially outwardly extending portion having substantially the same height as the tear strip and being formed integrally with the tear strip, said gusset having a significantly smaller height dimension than the height of said radially outwardly extending portion.

11. A closure cap as described in claim 10, said handle having a graspable outer portion extending substantially normal to said radially outwardly extending portion, and a second gusset bridging said radially outwardly extending portion and said normally extending outer handle portion to rigidify said handle.

12. A closure cap as described in claim 10, said gusset having an outer edge that defines an angle of about 20° to 50° between the tear strip and said outer edge.

* * * * *